United States Patent [19]

Buschelberger

[11] Patent Number: 4,944,602

[45] Date of Patent: Jul. 31, 1990

[54] HIGH PRESSURE HOMOGENIZING APPARATUS

[75] Inventor: Hanns-Georg Buschelberger, Vaterstetten, Fed. Rep. of Germany

[73] Assignee: Bran & Luebbe GmbH, Norderstadt, Fed. Rep. of Germany

[21] Appl. No.: 277,335

[22] Filed: Nov. 29, 1988

[30] Foreign Application Priority Data

May 28, 1988 [DE] Fed. Rep. of Germany ..... 3818237

[51] Int. Cl.[5] ..... B01F 5/06

[52] U.S. Cl. ..... 366/337; 366/176; 366/341

[58] Field of Search ..... 366/138, 176, 182, 336–340, 366/341, 348; 137/625.3, 625.33; 138/42, 46; 251/121, 212; 99/452

[56] References Cited

U.S. PATENT DOCUMENTS

| | | | |
|---|---|---|---|
| 2,504,678 | 4/1950 | Gardner | 366/340 |
| 2,882,025 | 4/1959 | Loo | 366/340 |
| 3,980,280 | 9/1976 | Benson | 366/176 |
| 4,199,267 | 4/1980 | Hendrikz | 366/302 |
| 4,383,769 | 5/1983 | Pandolfe | 251/121 |
| 4,585,357 | 4/1986 | Ogata | 366/337 |

*Primary Examiner*—Timothy F. Simone

*Attorney, Agent, or Firm*—Frishauf, Holtz, Goodman & Woodward

[57] ABSTRACT

A high pressure homogenizing apparatus for breaking-up micro-organisms or other micro-biological structures. The apparatus comprises a nozzle assembly through which a slurry or suspension to be treated is forced under high pressure. Between an inlet and an outlet, a cutting edge and, dowstream thereof, a circumferential recess are provided in a narrow gap of adjustable width.

16 Claims, 1 Drawing Sheet

HIGH PRESSURE HOMOGENIZING APPARATUS

BACKGROUND OF THE INVENTION

The present invention relates to a high pressure homogenizing apparatus and, in particular, to an apparatus of this type which is used to break-up biological and microbiological structures.

Prior art apparatus of this type includes a homogenizing nozzle assembly wherein a chamber is provided with an inlet and an outlet. The inlet and outlet communicate via an annular gap, the height or width of the gap being adjustable by means of a piston which is displaceable relative to a stationary nozzle portion. The biological masses to be subjected to a break-up or decomposition process are forced through the annular gap by means of a high pressure pump which generates pressures up to one thousand bar or even higher. Depending upon the masses to be treated, the cells are more or less easy to decompose. The degree of break-up may be improved if the mass is forced several times through the apparatus. Nevertheless, the result is mostly unsatisfactory.

SUMMARY OF THE INVENTION

It is an object of the present invention to provide an apparatus of the type specified above which produces an improved degree of break-up or decomposition.

According to the invention, the apparatus comprises a nozzle assembly including a cutting edge which defines a narrow circumferential gap downstream of the inlet. Downstream of the cutting edge, there is provided, concentrically with respect to the cutting edge, an annular recess which widens the annular gap, the depth of the widened space decreasing in a through-flow direction.

It has been found that due to these features, the degree of decomposition of the biological or cellular masses is greatly improved. This phenomenon is explained as follows:

Immediately adjacent the cutting edge, the gap width is extremely small in the order of magnitude of some μm's (micrometers) with a resulting extreme acceleration of the through-flow so that cavitation causes formation of bubbles with succeeding pressure increase, and collapsing of the bubbles with high local pressure pulses tending to decompose or break-up a first quantity of cells. The annular recess provided downstream forms a zone of turbulences resulting in further decomposition. Within the recess, there is established a micro-turbulent area, the smallest vortices having dimensions between 0.2 and 0.35 μm, depending upon the homogenizing pressure. As a result, pressure fluctuations exist of sizes by far smaller than the size of the structures to be broken up, thus contributing to the decomposition of these structures. Due to the superposition of the effects described above, even cells which are difficult to decompose may be efficiently treated to achieve a high degree of breakup. Using pressures of usually more than six hundred bars, a degree of decomposition between 60% and 90% may be reached with different microorganisms.

Further objects and advantages of the present invention will be explained hereunder with reference to the attached drawings which illustrate embodiments of the invention.

DETAILED DESCRIPTION OF THE PREFERRED EMBODIMENT

Figure 1:
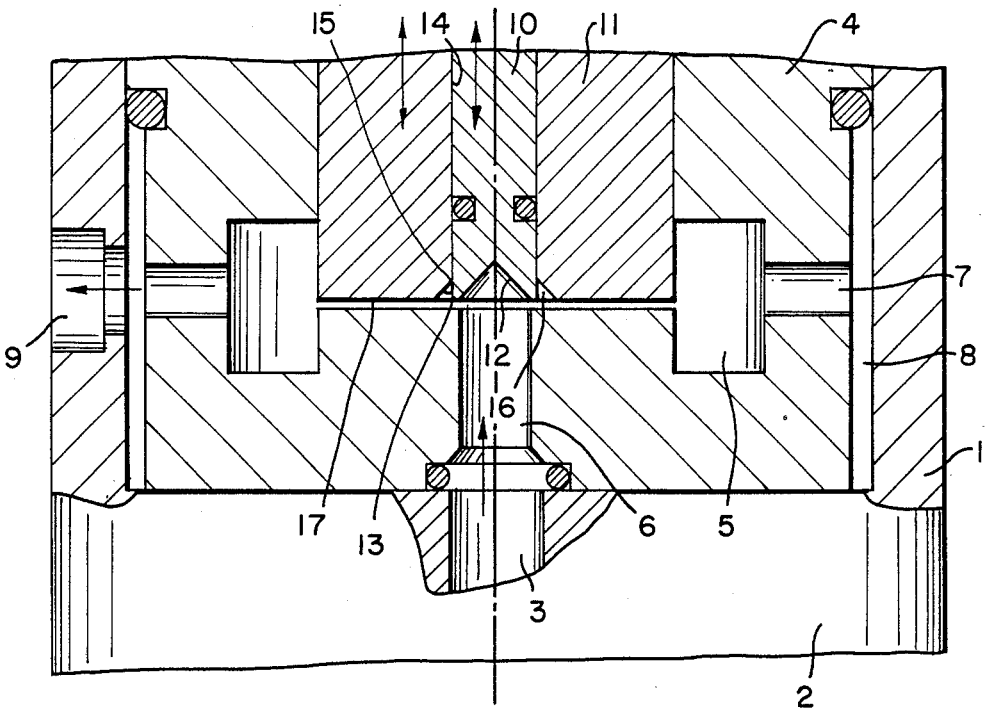
FIG.1 is a fragmentary view in section of a high pressure homogenizing apparatus showing the homogenizing nozzle in particular.

The embodiment illustrated in FIG. 1 includes a housing 1 having a bottom member 2. The bottom member has a central feeding channel 3 for feeding a suspension of biological particles. A sleeve 4 is received and fitted in the housing 1. Sleeve 4 defines a chamber 5 and a central inlet 6 which communicates with feeding channel 3 and opens into chamber 5. Chamber 5 has radial outlets 7 opening into an annular cavity 8 which surrounds sleeve 4 adjacent chamber 5. Broken-up suspension passes from annular cavity 8 to an exit channel 9 which traverses the wall of housing 1 and may be further processed, as desired.

Sleeve 4 houses a plunger 11 which, in turn, receives a concentrical piston 10 opposite the opening of inlet 6. At its front, piston 12 has a conical recess 12 so as to define at its circumference a cutting edge 13 having a diameter slightly exceeding the diameter of inlet 6 where it opens into chamber 5.

Plunger 11 has a concentrical bore 14 which receives and guides piston 10. The bore is chamfered at an angle of about 45° where it opens into chamber 5 so that an annular space 16 is defined between piston 10 and plunger 11, the section shape of the annular space being that of a regular triangle. From annular space 16, a radial gap 17 of uniform height extends to and opens into chamber 5.

Means (not shown) are provided for displacing piston 10 and plunger 11 independent of one another relative to inlet 6 so as to adjust the distance separating cutting edge 13 from the opposite chamber wall, and to adjust the height of gap 17. The displacing means are readily apparent to one with ordinary skill in the art. The displacing means may include mechanical, pneumatic, hydraulic, or electric drive means.

The distance separating cutting edge 13 from the opposite chamber wall is in the order of magnitude of some μm's (micrometers). The diameter of piston 10 is in the order of magnitude of some ten millimeters. Depth and width of chamfer 15 is between 0.1 and 1 mm, preferably 0.4 to 0.6 mm.

Figure 2:
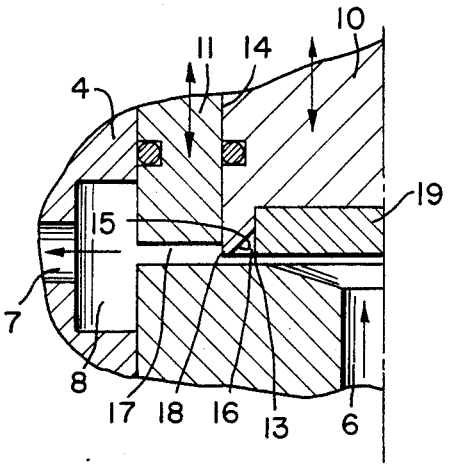
FIG. 2 and FIG. 3, respectively, illustrate further embodiments in similar manner, but with only one-half of the nozzle being shown.

As illustrated in FIG. 2, a second cutting edge may be provided downstream of annular space 16, the second edge contributing to break-up of the cells due to turbulences. As shown in FIG. 2, piston 10 is provided at its face with a wear absorbing plate 19, the circumferential edge forming such second cutting edge. A recess which houses plate 19 is provided with chamfer 15 to define annular space 16 having a section shape of a regular triangle. The depth of annular space 16 cannot be varied in this embodiment. The outer circumference of piston 10 forms the second cutting edge 18 from which gap 17 extends outwards, its height being adjustable by varying the distance separating plunger 11 from the opposite wall.

In order to provide a cutting edge 13 having a relatively large diameter, the opening of inlet 6 tapers outwards defining a trunconical space with an apex angle of about 10°.

Cutting edge 13 and annular space 16 may alternatively be provided adjacent the conical opening of inlet 6 in the wall of chamber 5 opposite piston 10.

Figure 3:
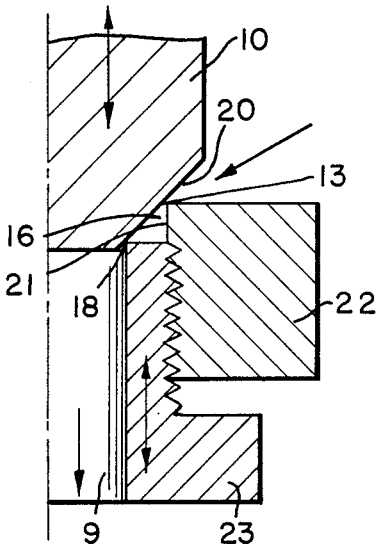

In the embodiment of FIG. 3, a central piston 10 is provided having a trunconical end portion with conical face 20 which extends into a bore 21 of a valve annulus 22. Bore 21 is partly threaded so as to receive a counter-threaded sleeve 23, the position of the latter relative to valve annulus 22 being adjustable upon relative rotation. Mechanical, hydraulic, pneumatic, or electrical drive means (not shown) may be provided for this purpose. The edge of bore 21 opposite face 20 forms cutting edge 13. The annular space or triangular section shape 16 is defined between the inner wall of bore 21 and the face of sleeve 23. The edge of an exit channel 9 adjacent conical face 20 forms a second cutting edge. Instead of a second cutting edge 18, sleeve 23 may have a conical surface extending parallel to face 20 so as to define an annular gap 17.

In the embodiment shown in FIG. 3, the suspension to be broken up flows first into chamber 5 surrounding piston 10 and then passes to exit channel 9. This design has the advantage that piston 10 is self-aligning with respect to cutting edge 13, and that those components which are subject to wear and tear are small and easily replaceable.

I claim:

1. A high pressure homogenizing apparatus for break-up of micro-organisms or other micro-biological structures, comprising a nozzle assembly having an inlet and an outlet, an annular gap communicating with said inlet and said outlet, said gap having a width transverse to a given flow direction, said nozzle assembly including a stationary member and means displaceable relative to said stationary member for adjusting the gap width, a cutting edge provided downstream of said inlet and having a defined circumference in a path of flow, a concentrical annular recess extending around said cutting edge and having a width transverse to said flow direction so as to exceed said gap width downstream of said cutting edge, said recess width decreasing in said flow direction.

2. The apparatus of claim 1 wherein a piston is displaceably mounted opposite a mouth of said inlet, said piston being provided with said cutting edge extending into a chamber between inlet and outlet, said cutting edge being circular and having a diameter slightly exceeding that of said inlet mouth which is circular.

3. The apparatus of claim 2 wherein said cutting edge defines a central piston recess of substantially conical shape at an end face of the piston.

4. The apparatus of claim 1 wherein said adjusting means includes a trunconical end, said stationary member being provided with said cutting edge, and said annular recess being defined by a conical surface portion of said trunconical end and by said stationary member.

5. The apparatus of claim 1 wherein said inlet opens into a chamber via an outwardly tapering mouth of substantially trunconical shape, said mouth being opposite a substantially plane front face of said gap width adjusting member.

6. The apparatus of claim 5 wherein said gap width adjusting member is provided at its front with a wear absorbing plate, said plate having an edge facing said inlet and forming said cutting edge.

7. The apparatus of claim 1 wherein said annular recess is defined by a sleeve which is displaceable relative to said cutting edge.

8. The apparatus of claim 7 wherein said sleeve is received by a valve seat provided with the cutting edge.

9. The apparatus of claim 7 wherein said sleeve is a plunger concentrically surrounding a piston which is provided with said cutting edge.

10. The apparatus of claim 9 wherein said annular recess is a chamfer of a guide bore provided in said plunger, said piston being displaceably received in said bore.

11. The apparatus of claim 1 including a second cutting edge downstream of said annular recess.

12. The apparatus of claim 1 wherein said annular recess has a substantially triangular section shape.

13. The apparatus of claim 1 wherein said annular recess has a maximum depth between 0.2 and 1 mm, preferably between 0.4 and 0.6 mm.

14. The apparatus of claim 12 wherein said section shape is a triangle having a 90° angle defined by two sides of preferably identical length.

15. The apparatus of claim 1 wherein said gap width adjusting means has a front face provided with a wear absorbing plate.

16. The apparatus of claim 15 wherein said gap width adjusting means has a chamfer adjacent said plate, said chamfer defining said annular recess.

* * * * *

UNITED STATES PATENT AND TRADEMARK OFFICE

CERTIFICATE OF CORRECTION

PATENT NO. : 4,944,602

DATED : July 31, 1990

INVENTOR(S) : BUSCHELBERGER et al

It is certified that error appears in the above-identified patent and that said Letters Patent is hereby corrected as shown below:

Title page, under Section [75] Inventor:

Insert the following two additional inventors:

Heiner Kaphengst, Hamburg, Germany

Rainer Klopp, Norderstedt, Germany

Signed and Sealed this

Twenty-ninth Day of March, 1994

*Attest:*

Bruce Lehman

BRUCE LEHMAN

*Attesting Officer*

*Commissioner of Patents and Trademarks*